US006041723A

United States Patent [19]

Peterson

[11] Patent Number: 6,041,723

[45] Date of Patent: Mar. 28, 2000

[54] PORTABLE COLLAPSIBLE SELF-ASSEMBLING DESK

[76] Inventor: Graham Peterson, 19 Hooper Creek Rd., Tryon, N.C. 28782

[21] Appl. No.: 09/160,784

[22] Filed: Sep. 24, 1998

Related U.S. Application Data

[60] Provisional application No. 60/060,135, Sep. 26, 1997.

[51] Int. Cl.[7] ..... A47B 3/00

[52] U.S. Cl. ..... 108/115; 108/38

[58] Field of Search ..... 108/35, 36, 38, 108/115, 128; 312/241, 244

[56] References Cited

U.S. PATENT DOCUMENTS

| | | | |
|---|---|---|---|
| 1,368,452 | 2/1921 | Puff | 108/35 |
| 2,473,022 | 6/1949 | Fenske, Jr. | 108/38 X |
| 2,662,989 | 12/1953 | Thatcher | 108/38 X |
| 2,750,243 | 6/1956 | Zielfeldt | 108/115 |
| 2,755,156 | 7/1956 | Nichols | 108/38 X |
| 2,837,394 | 6/1958 | Rahall | 108/115 X |
| 3,188,158 | 6/1965 | Sanchez | 108/38 X |
| 3,904,003 | 9/1975 | Margerum | 190/11 X |
| 4,913,502 | 4/1990 | Russell | 312/233 X |
| 4,934,280 | 6/1990 | Bae | 108/99 X |
| 5,102,209 | 4/1992 | Hesseltine | 312/290 |
| 5,403,082 | 4/1995 | Kramer | 312/249.9 X |
| 5,445,085 | 8/1995 | Westerburgen | 108/115 |

FOREIGN PATENT DOCUMENTS

| | | | |
|---|---|---|---|
| 65591 | 11/1949 | Netherlands | 108/115 |

*Primary Examiner*—Lynne H. Browne
*Assistant Examiner*—Brian H. Buck
*Attorney, Agent, or Firm*—Douglas W. Kim; Henry S. Jaudon; Cort Flint

[57] ABSTRACT

The portable collapsible self-assembling desk having a desktop, base unit, pivotal side supports, a tray and a lower shelf The desk in its collapsed configuration allows for easy transportation and storage and can be carried by a handle in a suitcase-like manner. The desk in its erected configuration provides a substantially horizontal work space. The pivotal side supports are automatically extended to provide support to the desktop allowing the desk to be easily converted between the collapsed and erected positions. These two configurations allow the desk to be in a collapsed configuration providing a small footprint and occupying substantially less space than when in the erect position.

23 Claims, 4 Drawing Sheets

PORTABLE COLLAPSIBLE SELF-ASSEMBLING DESK

This application claims priority on co-pending, provisional application Ser. No. 60/060,135 filed on Sep. 26, 1997 under 35 USC § 119(e).

BACKGROUND OF THE INVENTION

This invention relates to a portable, collapsible, self-assembling desk which may be collapsed for portability, shipment, or storage and which may be readily erected to a sturdy, useable configuration without need of assembly or other further effort. The desk in its collapsed configuration resembles a suitcase having a handle for one-handed carrying and easy portability.

The assembly of prior desks has required much time and effort, and often produces frustration since the parts and their assembly are numerous. Such desks are not readily useable when purchased due to the time and effort required for assembly, nor may they be folded for storage. Since such desks are not readily collapsed, unless taken apart, and those skilled in the art know that they tend to remain in the taken apart or the erected configuration and are not often converted between these configurations. Such desks generally are not easily collapsed and remain in their assembled position thereby occupying more space and preventing the area occupied by the desk from being utilized for other uses.

Examples of various tables which fold include U.S. Pat. No. 1,766,616 which discloses a table having a foldable base and anglable top. U.S. Pat. No. 1,975,857 discloses a table with a tiltable top which can be collapsed. U.S. Pat. No. 1,990,032 discloses a folding table utilizing a locking bar for positioning the table top in a upright or flat position. U.S. Pat. No. 3,191,555 which discloses a folding desk designed for use as a study desk or sewing machines or the like. This invention consists of crossed u-shaped legs which pivot to fold the desk. U.S. Pat. No. 5,259,305 which discloses an improvement upon an office desk or table which allows the legs to fold under the table by loosening screws, moving the legs out from under the table, and tightening the screws.

While the above applications allow for foldable tables and desks, the easily collapsible desk with a design allowing ample desktop space and self-assembly is a problem to which considerable attention should be given. The present desk, having such easy assembly, allows the space taken by the erected desk to be substantially recovered for other use when the desk is in the collapsed configuration. Also, the desk in the collapsed configuration allows the desk to be portable and transported in a suitcase-like manner. By providing self-assembly functionality, the present invention greatly improves over the prior designs for desks which currently exists in the field.

Accordingly, the object of the present invention is to provide a portable collapsible self-assembling desk which may be collapsed thereby taking considerably less space in this configuration and which may be readily unfolded to a sturdy, useable configuration with little need of assembly or other further effort. The desk in the collapsed configuration will substantially reduce the footprint of the space occupied by the desk as compared to the erected configuration.

Another object of this invention is to have a portable collapsible desk which can be carried in a suitcase like manner utilizing a handle thereby only requiring one hand for portability and transportation.

Another object of the present invention is to provide a portable collapsible self-assembling ready-to-use desk which contains a tray and a lower shelf for storing various materials beneath the desktop. Both the lower shelf and the tray will add structural support to the desk in the erected configuration by acting as cross-braces. The lower shelf can also serve as a modesty screen preventing anyone from viewing underneath the desk when the desk is in the erected configuration.

SUMMARY OF THE INVENTION

The above objectives are accomplished in the present invention by providing a portable collapsible self-assembling desk having a desktop, base pivot unit, tray, and lower shelf and pivotal side supports. The desk, in its collapsed configuration, allows for easy transportation and storage. With a handle connected to a base unit the desk can be carried in a suitcase-like manner only requiring one hand. Primarily, the desk contains a base pivot unit with a front side, a rear side and a first and second side, and a base top. Also the desk may contain a desktop, a tray, a lower shelf, a first pivotal side support and a second pivotal side support. The desktop is connected to the base pivot unit in a manner which allows the desktop to pivot on a horizontal axis from a downward pivoted position when the desk is in a collapsed configuration to an upward position which is generally 180 degrees opposite the downward position. When the desktop is in the downward position the desktop co-extends with at least a portion of the rear side of the base pivot unit forming a compact, collapsed, desk with easy portability.

The desktop also has a work position where the desktop rests on the pivotal side supports providing a generally horizontal working surface. The pivotal side supports can be manufactured to provide a generally horizontal or tilted work surface when the desktop engages the pivotal side supports in the work position. The pivotal side supports have floor engaging supports so that when the desktop is in the work position, the pivotal side supports support the desktop above the floor.

The pivotal side supports are connected to the base pivot unit allowing them to pivot on a vertical axis from a retracted position to an extended position. When the pivotal side supports are in the retracted position, they are generally contained within the storage space of the base pivot unit.

The base pivot unit has a storage space, defined by the front, rear, first and second sides, which accepts the pivotal side supports thereby making a more compact transportable desk with a smaller footprint when the desk is in the collapsed configuration than when the desk is erected.

The desk also has a tray connected to the base pivot unit in a manner allowing the tray to pivot on a horizontal axis. When the tray is in its downward position, it is also contained with the storage space of the base pivot unit again allowing for a more collapsed transportable desk with a small footprint. The desk also has a lower shelf which is connected to the base pivot unit. The lower shelf is connected in a manner to allow it to pivot from a raised position to a lowered position. The raised position of the shelf allows the shelf to operate as a vanity screen preventing anyone from viewing under the desk when the desk is erected. The raised position of the shelf allows the desk to collapse while leaving room for the tray and pivotal side supports to be contained within the storage space of the base pivot unit. When in the lowered position, the shelf allows for the storage of books as well as to provide additional support to the structural integrity of the desk as a whole increasing the stability of the desk in the erected configuration.

The self-assembling feature is operated by raising the desktop from the downward position to the upward position.

The desktop is connected to the pivotal side supports by a flexible connection assembly so that when the desktop is raised, the pivotal side supports are automatically extended from their retracted position to their extended position. This allows the extension of the pivotal side supports to be achieved in one step.

Once the pivotal side supports are extended, the desktop is lowered to its work position and rests on the pivotal side supports in either a tilted position or a horizontal position, providing different desktop configurations. These positions are achieved by a leveling bar pivotally attached to the underside of the desktop. The leveling bar allows the desktop to rest on the pivotal side supports providing a tilted working surface when the leveling bar is raised and a generally horizontal surface when the leveling bar is lowered. The raised and lowered position of the leveling bar allows for adjustment of the tilt of the desktop and working surface.

Once the support members are extended and before the desktop is placed in its work position, the tray can be lifted to its raised position and connected to the pivotal side supports providing a tray for storage of various material under the desktop. By connecting to the pivotal side supports to the tray, additional support for the desk is provided. Once the upper tray has been attached, the desktop is lowered and rests on the pivotal side supports.

In order to facilitate carrying of the desk, a handle is connected to the base top of the base pivot unit. The handle has a storage position and a carrying position. The carrying position allows the desk to be transported in a suitcase like manner when the desk is in the collapsed configuration. The handle is raised from a recess in the base top facilitate carrying the desk. In the storage position, the handle is lowered and recesses into a space in the base top. The top surface of the base pivot unit therefore is not interfered with by the handle when the handle is in the storage position.

DESCRIPTION OF THE DRAWINGS

The invention will be more readily understood from a reading of the following specification and by reference to the accompanying drawings attached and incorporated herein by reference.

DESCRIPTION OF THE PREFERRED EMBODIMENT

Figure 4:
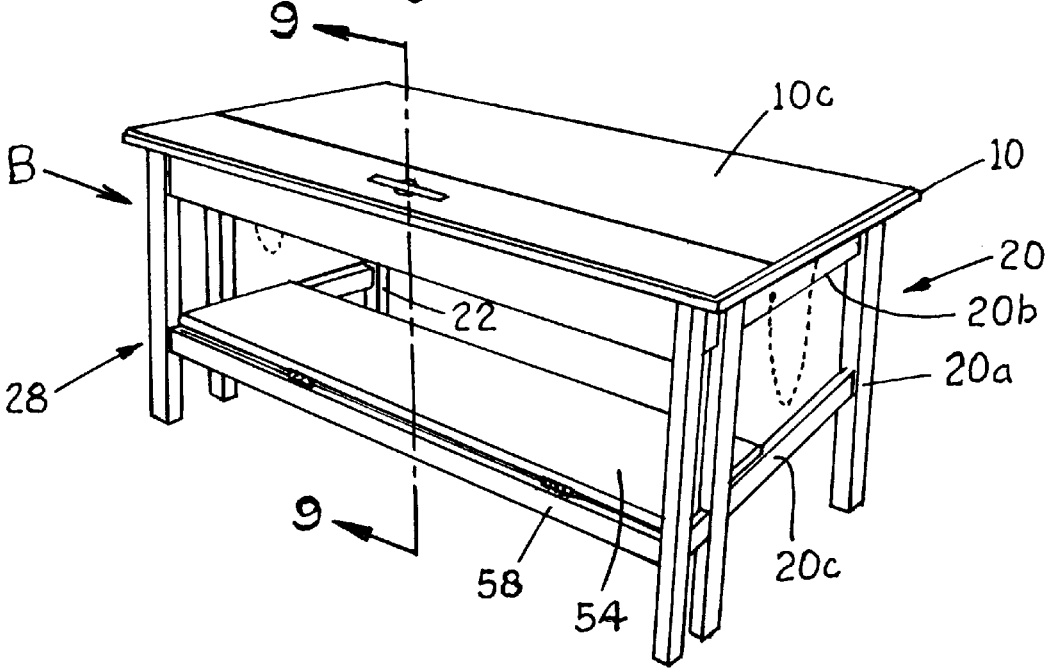
FIG. 4 is rear perspective view of the portable collapsible self-assembling desk in an erected configuration.

Referring to the drawings, the invention will now be described in more detail. As best can be seen from FIG. 1, a collapsible, self-assembling desk is illustrated generally as A, having a freestanding base pivot unit, generally designated as B. A desktop 10 is pivotally connected to base pivot unit B. Desktop 10 is shown in both its downward position 10*a* and in its raised position 10*b*. As will be discussed, this pivoting motion allows the desktop to collapsed into a downward position which substantially reduces the footprint and the amount of space occupied by the desk when compared to its erected configuration (FIG. 4).

In the present invention, a handle is carried by a base top 12 of base pivot unit B to provide a carrying method much like a suitcase. This handle can be seen in FIG. 1 and is designated 16. The handle has a carrying position (dotted lines) and a storage position. In the carrying position, the handle is raised away from the top of the base pivot unit providing a method of carrying the desk with one hand. When the handle is in the storage position, a space 18 in the top of base pivot unit B receives the handle and allows the handle to recess generally beneath base pivot unit top surface 12*a*. This configuration can best be seen from FIG. 9. Handle 16 is shown in the storage position contained with space 18 on the top surface 120 of base pivot unit B. The handle, in this storage position, allow the desk surface of desktop 10 and base top 12 of base pivot unit B to form a generally flat work surface. FIG. 4 illustrates the desk in the erected configuration with the desktop and the top of the base pivot unit forming a relatively flat working surface while handle 16 is recessed into to the base pivot unit. FIG. 4 also shows desktop 10 in the work position engaging a first pivotal side support 20 and a second pivotal side support 22 creating a stable, generally horizontal working desk.

Figure 1:
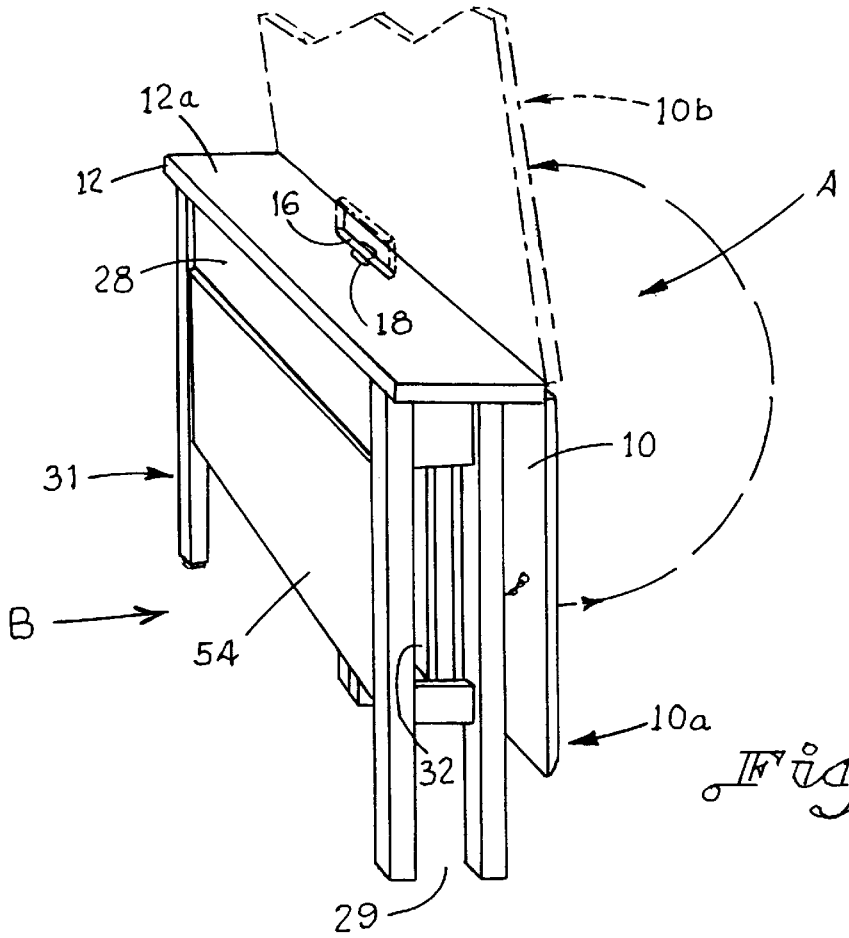
FIG. 1 is a side perspective view of the portable collapsible self-assembling desk as constructed in the present invention in its collapsed configuration, and also shows an upward position of the desktop in the dotted lines.
Figure 2:
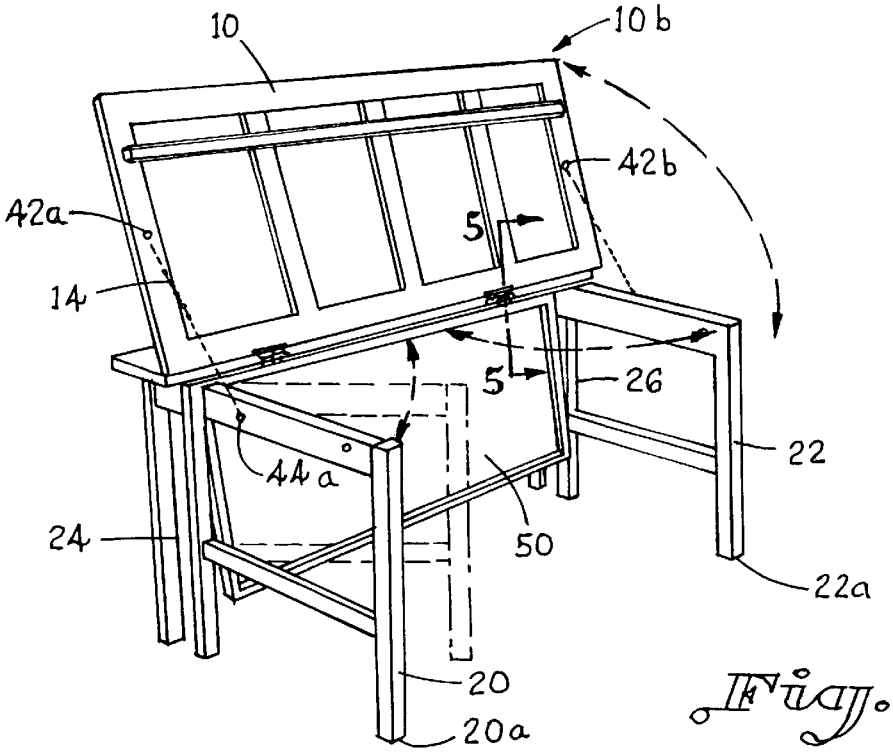
FIG. 2 is a front perspective view illustrating the positions of the various elements of the portable collapsible self-assembling desk in a semi-assembled position.

FIG. 2 shows desktop 10 in its raised position 10*b*. In this figure, first pivotal side support 20 and second pivotal side support 22 are shown in their extended positions. First pivotal side support 20 is pivotally carried by a first side 24 of base pivot unit B. Second pivotal side support 22 is pivotally carried by a second side 26 of base pivot unit B. These pivotal side supports 22, 24 have a retracted position (FIG. 1) and an extended position (FIG. 4). When in the extended position, the pivotal side supports are generally parallel to base units first side 24 and second side 26. In the extended position, the first and second pivotal side supports engage with the floor which provides support for the desktop when the desktop is in its work position (FIG. 4) thereby engaging the first and second pivotal side supports. The pivotal side supports terminate in floor supports 20*a* and 22*a* respectively, which allows the pivotal side supports to support desktop 10 above the floor. In the present embodiment, each pivotal side support has a top crosspiece, a bottom crosspiece and a leg. FIG. 4, illustrates the top crosspiece 20*b* of first pivotal side support 20, the bottom crosspiece 20*c* and the leg 20*a*. As described above, leg 20*a* terminates in a floor support. The frame formed by leg 20*a*, top crosspiece 20*b*, and bottom crosspiece 20*c* provide for lightweight pivotal side support structure while also providing structural stability to support desktop 10. The light weight construction allows for a more transportable desk.

In viewing FIG. 1, it can be seen that the base pivot unit has a front side 28, a rear side (30 of FIG. 9), a first and second side 29, 31. A storage space 32 is formed within a perimeter defined by these sides of the base pivot unit. The storage space receives the first and second pivotal side supports when they are in the retracted position. When the desk is in its collapsed configuration and the first and second pivotal side supports are in their retracted position contained within the storage space, the desktop is free to pivot into its downward position (FIG. 1) and provides a reduced foot print therefore substantially reducing the space occupied by the desk. The difference between these two positions is illustrated by comparing the collapsed configuration of FIG. 1 and the erected configuration of FIG. 4.

Figure 9:
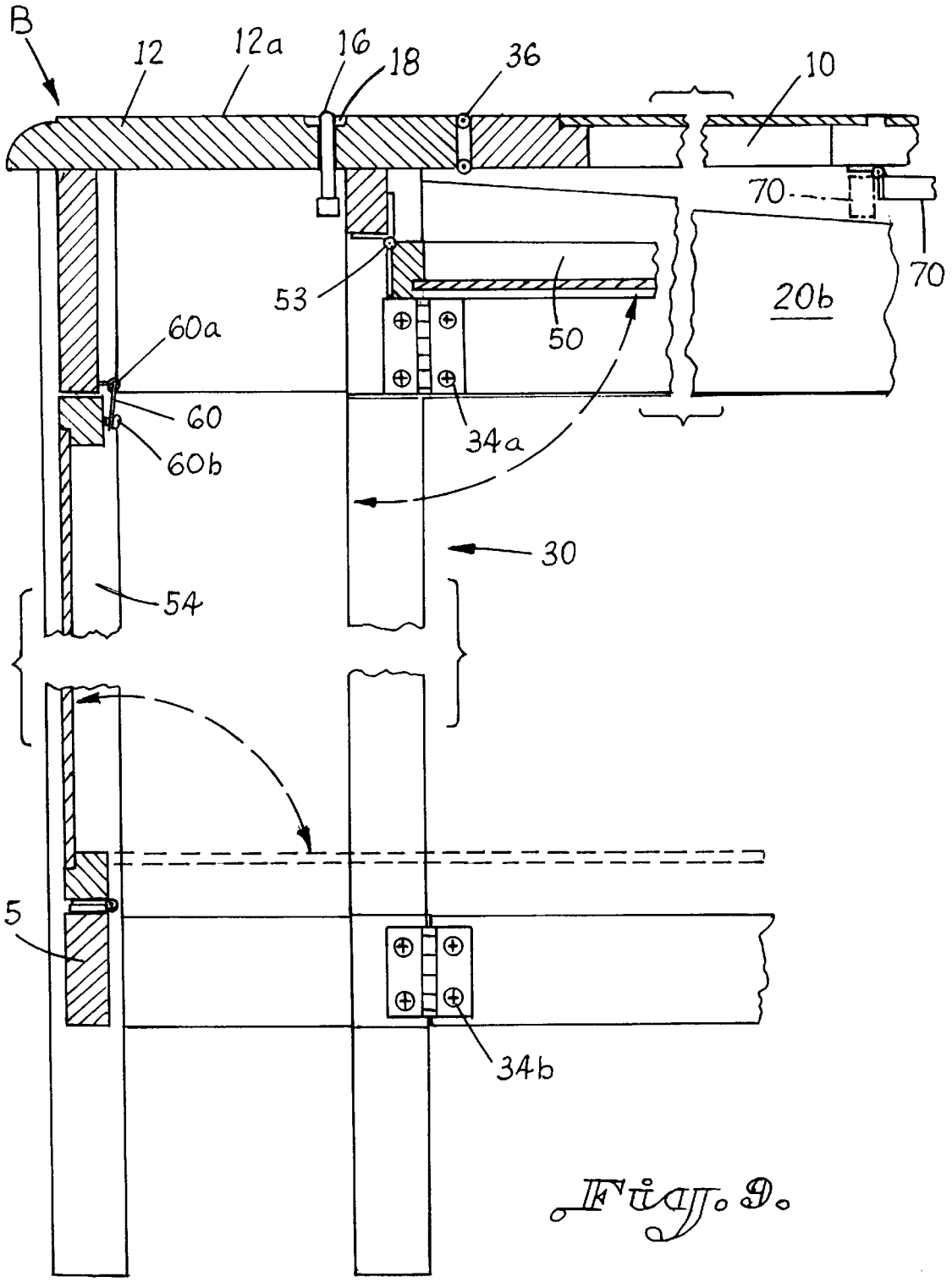
FIG. 9 is a cross-sectional view of a portable collapsible self-assembling desk taken along line 9—9 of FIG. 4, illustrating the elements contributing to the collapsible and self-assembling functions.

FIG. 9 shows a more detailed illustration of the connection between base pivot unit B and pivotal support sides 20, 22. In the present invention, two hinges 34*a* and 34*b* connect first pivotal side 20 to base pivot unit B. This allows the pivotal side supports to pivot into the storage space of the base pivot unit when the desk is collapsed and to pivot to an extended position when the desk is erected.

Figure 5:
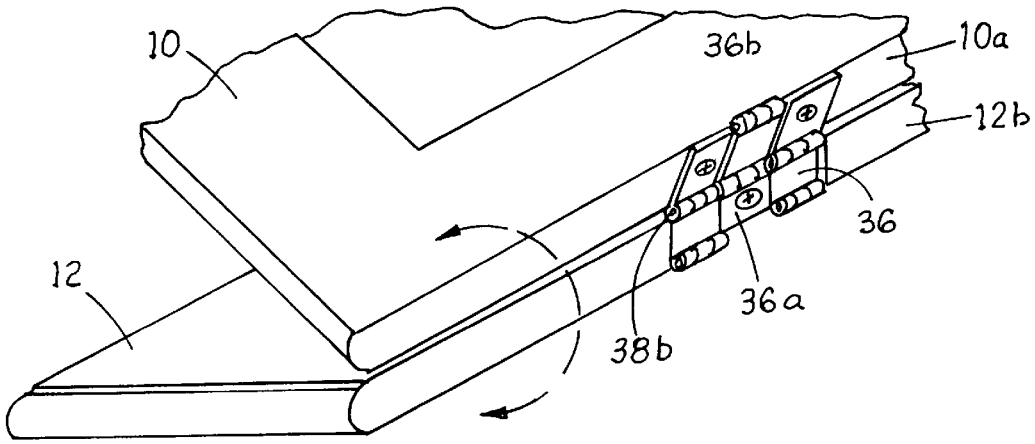
FIG. 5 is a perspective view of the a desktop double pivot hinge connecting the desktop to the base pivot unit with the desktop in its upward position as when the desktop is partially assemble and the pivotal side supports are being extended.
Figure 6:
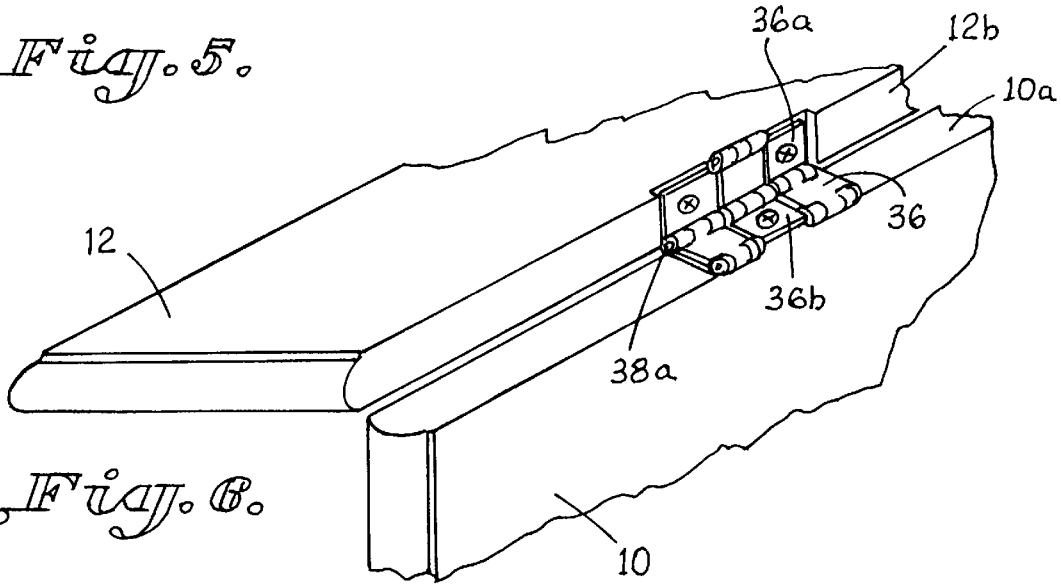
FIG. 6 is a perspective view of the a desktop double pivot hinge connecting the desktop to the base pivot unit with the desktop in its downward position as when the desk is collapsed.

Double pivot hinge 36 is shown in FIG. 9 connecting between base top 12 and desktop 10. The double pivot hinge has a first part 36*a* and a second part 36*b*. First part 36*a* is connected along inside edge 12*b* of base top 12. Second part 36*b* is connected along inside edge 10*a* of desktop 10. FIGS. 6 further illustrate double pivot hinge 36 when desktop 10 is in the downward position. Double pivot hinge 36 has a first pivot axis 38*a* which allows movement of desktop 10 between a work position (FIG. 4) and a downward position (FIG. 1). FIG. 5 further illustrates double pivot hinge 36 with desktop 10 in the upward position (FIG. 2). Double pivot hinge 36 has a second pivot axis 38*b* which allows movement of desktop 10 from the work position (FIG. 4) to the upward position (FIG. 2). First and second pivot axis, 38*a* and 38*b*, allow the desktop to have a range of motion from the downward position (FIG. 1) to the upward position (FIG. 2).

FIG. 2 best illustrates the pivotal connection between desktop 10 and the pivotal side supports 20 and 22 which provides for the automatically pivoting of the pivotal side supports from the retracted position to the extended position. A flexible connection assembly, designated generally as between desktop 10 and pivotal side supports 20, 22 achieves this functionality. In the present invention, flexible chains 14 are used to connect the underside of the desktop at connection points 42*a* and 42*b* to connection points 44*a* and 44*b* respectively, on the pivotal side supports. When desktop 10 is raised from its downward position as shown in FIG. 1 to its upward position as shown in FIG. 2, tension is placed on chains 14 which in turn places tension on the attachment points of the pivotal side supports and forces then to pivot from their retracted position within the storage space to their extended position as shown in FIG. 2. This allows the pivotal side supports to be extended simultaneously from the base unit in one simple step using one hand to assemble the desk and provide support for the desktop when the desk is in its erected configuration.

As shown in FIG. 4, when first pivotal side support 20 and second pivotal side support 22 are extended desktop 10 engages the first and second side supports, a generally horizontal surface 10*c* is formed providing a full sized, stable, easy to assemble, working surface.

Advantageously, in the present embodiment, the desk has a tray pivotally attached to the base pivot unit. FIG. 2 shows tray 50 pivotally connected to base pivot unit B with the tray in its lowered position. When in the lowered position, the tray is also contained within storage space 32 (FIG. 1) of base pivot unit B. This allows the desk to have a substantially reduced footprint when the desk is in the collapsed configuration. FIG. 2 shows that in the present embodiment, tray 50 is contained within the storage space with the pivotal side supports 20 and 22 pivoting into the storage space and along side the tray when the desk is in the collapsed configuration. FIG. 9, a cross-section of FIG. 9—9, shows a detailed view of the pivot connection between base pivot unit B and tray 50. As shown, hinge 53 connects tray 50 to rear side 30 of base pivot unit B. This connection allows the tray to be raised in a horizontal position for use with the erected desk as well as to be lowered to be contained within the storage space providing a collapsed, compact, transportable desk with a small footprint.

Figure 3:
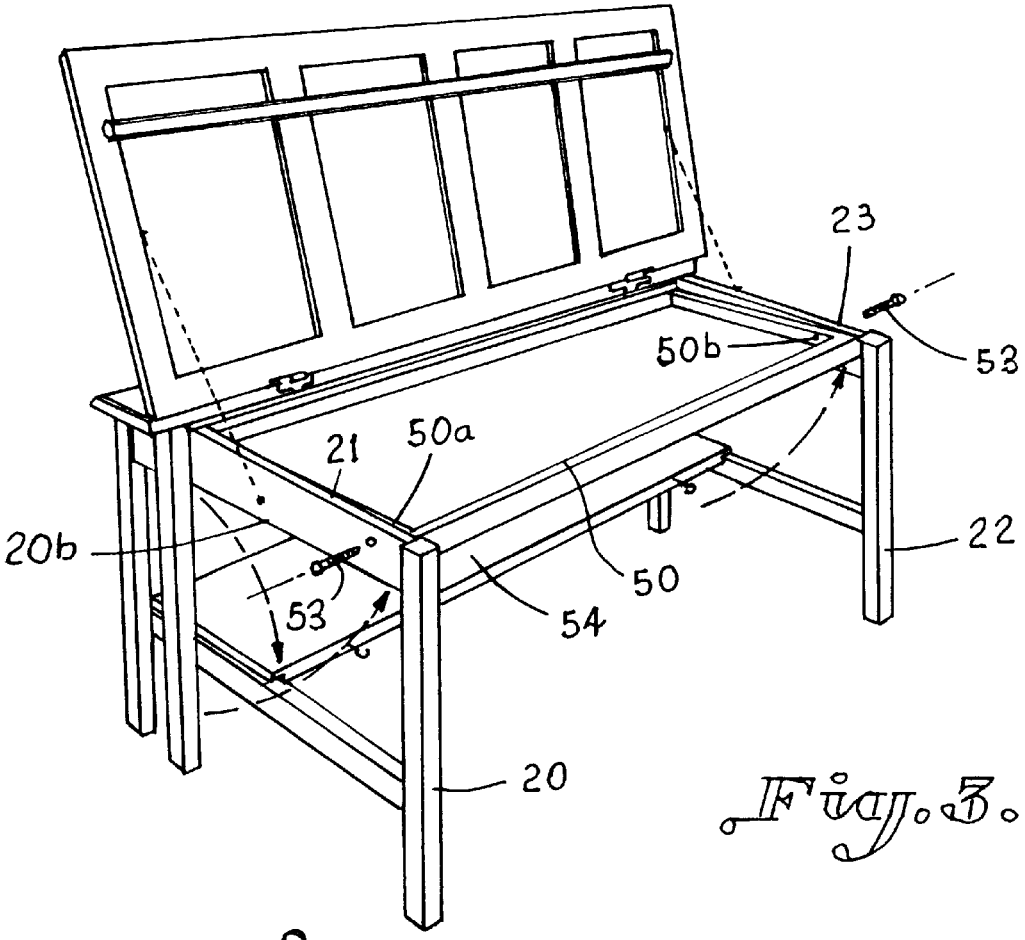
FIG. 3 is a front perspective view illustrating various positions and movements of elements of the portable collapsible self-assembling desk in a semi-assembled position.

When the desk is in the raised position, as shown in FIG. 3, tray 50 is attached to the first and second pivotal side support. In this configuration tray 50 acts as a crosspiece between pivotal side support 20 and pivotal side support 22 adding additional structural stability when the desk is in the erected configuration. In the present embodiment, the tray has a first aperture 50*a* and a second aperture 50*b* which correspond with aperture 21 and 23 receptively of pivotal side supports 20 and 22. The apertures in the tray align with the apertures in the pivotal side supports to allow screws 52 to be fastened through the respective apertures and secure the tray to the pivotal side supports. This configuration provide both a storage space beneath the desktop 10 as well as providing a cross-brace for additional structural support for the desk in the erected configuration.

In addition to the tray, the present embodiment may also contain a lower shelf 54 (FIG. 4), pivotally connected to base pivot unit B. FIG. 4, showing the desk in the erected configuration, shows lower shelf 54 pivotally connected to a cross member 56 of front side 28 of base pivot unit B. Lower shelf 54 is shown in its downward position which provides a storage space for such items as books, papers, supplies or other materials. In the present embodiment, lower shelf 54 engages pivotal side supports 20 and 22 to further provide a cross-brace and structural support to the desk when the desk is in the erected configuration.

FIG. 3 shows lower shelf 54 pivoting from the raised position to the downward position and engaging pivotal side supports 20 and 22. When the lower shelf is in the raised position, the shelf serves as a modesty or vanity screen preventing anyone from viewing under the desk. FIG. 1 shows lower shelf 54 in the raised position and flush with front side 28 of base pivot unit B. When in its raised position, the lower shelf can be locked in this position with latches. FIG. 9 is a cross-section of FIG. 4 and best illustrated the pivotal connections between base pivot unit B and lower shelf 54. From FIG. 9, it can be seen that the lower shelf is pivotally connected to front side 28 of base pivot unit B. Specifically, lower shelf 54 is connected to a lower cross member 58 of front side 28 allowing lower shelf 54 to pivot from a vertical position flush with front side 28 to a horizontal position. This pivot connection allows the shelf to be contained flush with or within the base unit providing a compact, transportable desk with a substantially smaller footprint when in the collapsed configuration.

The latches which secure the lower shelf in the upright position can best be described when viewing FIG. 9. In FIG. 9, lower shelf 54 is shown in its upward position. In the embodiment on this invention, lower shelf 54 is latched to front side 28 of the base pivot unit B by a latch 60 having a first part 60*a* connected to the front side if the base pivot unit and a second part 60*b* connected to the lower shelf.

Figure 7:
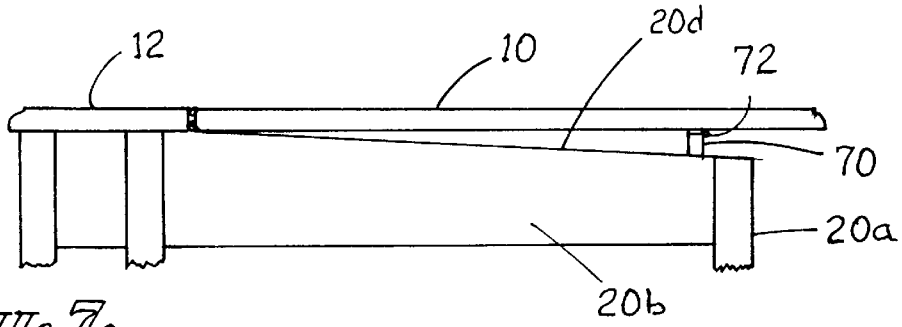
FIG. 7 is a side elevation of a desktop illustrating a leveling bar in the lowered position.

In the present embodiment the desktop can be configured in a generally horizontal manner as well as a tilted or sloped manner. FIG. 7 illustrates the desktop in the generally horizontal position. Desktop 10 is shown connected to base top 12. A leveling bar 70 is connected to the underside of base top 10 by hinge 72. FIG. 7 shows the leveling bar in the lowered position. As illustrated, top cross piece 20*b* of the pivotal side support is tapered downward and away from the base top. Therefore, when the desktop is in its work position as shown, leveling bar 70 engages pivotal support top cross piece 20*b* thereby providing a generally horizontal work space.

Figure 8:
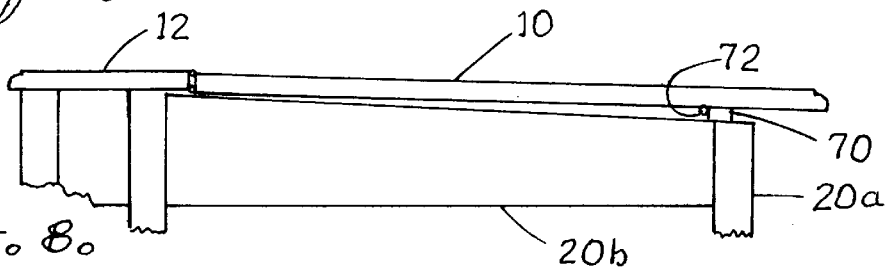
FIG. 8 is a side elevation of a desktop illustrating a leveling bar in the raised position.

FIG. 8 illustrates desktop 10 in a generally sloped work space. Leveling bar 70 is in the raised position thereby providing less space between desktop 10 and top cross piece 20*b*. The results when desktop 10 is in the work position is to provide a work surface which is generally sloped downward away from base top 12. The raised and lowered configuration of leveling bar 70 allows for the desktop to be configured in at least two positions to provide more functionality for the user.

The present invention allows a full size desk in the erected position while substantially reducing the footprint to recover usable space when the desk is in the collapsed position. The collapsed position also provides for an easily portable, collapsible desk. The self-assembly features make practical assembling the desk from the collapsed configuration to the erected configuration and back with little effort.

What is claimed is:

1. A portable, collapsible, self-assembling desk, said desk having a collapsed configuration and an erected configuration, comprising:

a stand alone base pivot unit having a front side, a rear side, and first and second fixed sides adjoining said front and rear sides;

a storage space defined within a perimeter of said front side, said rear side, said first fixed side and said second fixed side;

a desktop pivotally carried by said base pivot unit, said desktop having an upward position, a downward storage position and a work position;

a first pivotal side support pivotally carried by said base unit, said first pivotal side support having a retracted position when said desk is in said collapsed configuration, and an extended position when said desk is in said erected configuration;

a second pivotal side support pivotally carried by said base unit, said second pivotal side support having a retracted position when said desk is in said collapsed configuration, and a extended position when said desk is in said erected configuration;

said pivotal side supports are contained within said storage space when said desk is in said collapsed configuration, said first and said second pivotal side supports are generally perpendicular to said rear side of said base pivot unit when said pivotal side supports are in said extended position;

a first flexible connection assembly connected between said desktop and said pivotal side supports so that said pivotal side supports are automatically pivoted from said retracted position to said extended position when said desktop is pivoted from said downward position to said upward position;

said first and second pivotal support sides engage said desktop to support said desktop in a generally horizontal fashion when said desktop is in said work position and said desk is in said erected configuration;

a tray pivotally carried by said rear side of said base pivot unit, said tray having a lowered position when said desk is in said collapsed configuration, said tray having a raised position when said desk is in said erected configuration;

a fastening assembly for attaching said tray to said first and second pivotal side supports providing for additional structural support when said desk is in said erect position;

said tray in said lowered position being recessed within said storage space and said first and second side supports being recessed within said storage space when said desk is in said collapsed configuration so that a highly portable compact desk is provided.

2. The desk of claim 1 wherein:

said first and second side supports are tapered downwardly away from said base unit so that a tilted work surface is provided when said pivotal side supports are extended and said desk is in said erected configuration.

3. The desk of claim 1 wherein:

said desktop has an underside;

a leveling bar pivotally connected to said underside of said desktop;

said leveling bar having a raised position so as to engage said first and second pivotal side supports so as to place said desktop in a generally tilted slope away from said base unit when said desktop is in said work position, and;

said leveling bar having a lowered position so as to engage said first and second pivotal side supports so as to place said desktop in a generally horizontal position when said desktop is in said work position.

4. The desk of claim 1 further comprising:

a connection between said tray in its raised position and said first and second pivotal side supports thereby providing additional structural strength to said desk.

5. Then desk of claim 1 further comprising:

a lower shelf;

said lower shelf having a raised position so that said lower shelf is generally flush with said front side of said base pivot unit providing a modesty screen preventing viewers from viewing underneath said desk when said desk is in its erected configuration, and;

said lower shelf having a lowered position so as to provide a lower shelf as well as additional stability to said desk.

6. The desk of claim 1 wherein:

said pivotal side supports having a leg, a top crosspiece and a bottom crosspiece;

said top and bottom crosspieces pivotally carried by said base unit, and;

said leg adjoining said top crosspiece and said bottom crosspiece of said pivotal side support forming a frame providing a light, sturdy structure for supporting said desktop when said desktop is in its work position.

7. The desk of claim 1 wherein said flexible connection assembly is at least a first chain connecting said desktop to said first side support and a second chain connecting said desktop to said second pivotal side support.

8. A portable, collapsible, self-assembling desk, said desk having a collapsed configuration and an erected configuration, comprising:

a freestanding base unit of fixed size having a front side, a rear side, and first and second sides adjoining said front and rear sides;

a storage space defined within a fixed perimeter of said front side, said rear side, said first side and said second side;

a desktop pivotally carried by said rear side of said base unit;

a first pivotal side support, a second pivotal side support and pivotal members pivotally connecting said first and second pivotal side supports in fixed spaced relation of said front side;

said first and second pivotal side supports terminating in floor engaging supports;

said first pivotal side support having a retracted position in which said first pivotal side support is generally disposed within said storage space, and said first pivotal side support having an extended position in which said first pivotal side support is pivoted away from said base unit to engage the floor to support said desktop in a generally horizontal position;

said second pivotal side support having a retracted position in which said second pivotal side support is generally disposed within said storage space, and said second pivotal side support having an extended position in which said second pivotal side support is pivoted away from said base unit to engage the floor to support said desktop in a generally horizontal position, and;

said desktop having a work position when supported-by said first and second pivotal side support when said desk is in said erected configuration, wherein said desktop is generally horizontal, and said desktop having a downward position when said desk is in said collapsed configuration to co-extend over at least a portion of said rear side of said base unit in said collapsed configuration so that a compact, collapsed desk is provided for portability.

9. The desk of claim 8 wherein said base unit includes:

a base top;

a handle carried by said base top, said handle having a storage position and a carrying position, and;

said carrying position allowing said desk to be carried by one hand in a suitcase manner further providing an easily portable and transportable desk.

10. The desk of claim 9 wherein said:

base top includes a recess space for receiving said handle in said storage position wherein said handle is generally below a surface of said base top while allowing transportation with one hand when said handle is removed from said recess space.

11. The desk of claim 8 wherein:

said first and second side supports are tapered downward away from said base unit so that a tilted work surface is provided when said pivotal side supports are extended and said desk is in said erected configuration.

12. The desk of claim 11 wherein:

said desktop having an underside;

a leveling bar pivotally connected to said underside of said desktop;

said leveling bar having a raised position so as to engage said first and second pivotal side supports so as to place said desktop in a generally tilted slope away from said base unit when said desktop is in said work position, and;

said leveling bar having a lowered position so as to engage said first and second pivotal side supports so as to place said desktop in a generally horizontal position when said desktop is in said work position.

13. The desk of claim 8 further comprising:

a cross-brace bracing between said first and second pivotal side supports when said desk is in said erected configuration.

14. Then desk of claim 13 wherein:

said cross-brace is a lower shelf;

said lower shelf having a raised position so that said lower shelf is generally flush with said front side of said base pivot unit providing a modesty screen preventing viewers from viewing underneath said desk when said desk is in its erected configuration;

said lower shelf in said raised position allowing for said storage space of said base unit to receive said pivotal side supports in their retracted position, and;

said lower shelf having a lowered position so to provide a lower shelf and additional stability to said desk when said desk is in said erected configuration.

15. The desk of claim 14 further comprising:

a tray pivotally connected to said rear side of said base unit;

said tray having a downward position when said desk is in said collapsed configuration;

said tray having a raised position when said desk is in said erected configuration, and;

a connection between said tray in its raised position and said first and second pivotal side supports thereby providing additional structural strength to said desk when said desk is in said erected configuration.

16. The desk of claim 13 further comprising:

a tray pivotally connected to said rear side of said base unit;

said tray having a downward position when said desk is in said collapsed configuration; said tray having a raised position when said desk is in said erected configuration, and;

a connection between said tray in its raised position and said first and second pivotal side supports thereby providing additional structural strength to said desk when said desk is in said erected position.

17. A portable, collapsible, self-assembling desk, said desk having a collapsed configuration and an erected configuration, comprising:

a base unit;

a desktop pivotally carried by said base unit, said desktop having an upward position and a downward position;

a first pivotal side support pivotally carried by said base unit, a second pivotal side support pivotally carried by said base unit;

said first and second pivotal side supports having both an extended position and a retracted position, said pivotal side supports being folded generally adjacent said base unit when said pivotal side supports are in said retracted position, said pivotal side supports being extended away from said base unit when said pivotal side supports are in said extended position;

a first flexible connection assembly connecting said desktop to said first pivotal side support and said second pivotal side support;

said flexible connection assembly being connected between said desktop and said pivotal side supports to move said pivotal side supports from said retracted position toward said extended position when said desktop is pivoted from said downward position to said upward position, so that said pivotal side supports are extended automatically by movement of said desk top and in one step, and;

said desktop having a work position when said first and second pivotal side supports are in an extended position so that said desktop engages said first and second pivotal side supports to form a generally horizontal surface.

18. The desk of claim 17, further comprising:

at least a first double hinge affixing said desktop to said base unit allowing said desktop to have said downward position, said upward position and said work position.

19. The desk of claim 17 wherein:

said first double hinge having a first pivot axis;

said first pivot axis allowing said desktop to pivot from said downward position to said work position of said desktop;

said first double hinge having a second pivot axis, and;

said second pivot axis allowing said desktop to pivot from said work position to said raised position of said desktop.

20. The desk of claim 17 wherein said base unit includes:

a base top;

a handle carried by said base top, said handle having a storage position and a carrying position, and;

said carrying position allowing said desk to be carried by one hand in a suitcase manner further providing an easily portable and transportable desk.

21. The desk of claim 20 wherein said:

base top includes a recessed space for receiving said handle in said storage position wherein said handle is generally below a surface of said base top while allowing transportation with one hand when said handle is removed from said recess space.

22. The desk of claim 17 further comprising:

a tray pivotally connected to said rear side of said base unit;

said tray having a downward position when said desk is in said collapsed configuration;

said tray having a raised position when said desk is in said erected configuration, and;

a connection between said tray in its raised position and said first and second pivotal side supports thereby providing additional structural strength to said desk.

23. Then desk of claim 17 further comprising:

a lower shelf;

said lower shelf having a raised position so that said lower shelf is generally flush with said front side of said base unit providing a modesty screen preventing viewers from viewing underneath said desk when said desk is in its erected configuration, and;

said lower shelf having a lowered position so as to provide a lower shelf as well as additional stability to said desk.

* * * * *